US006305531B1

(12) United States Patent
Wilkman

(10) Patent No.: US 6,305,531 B1
(45) Date of Patent: Oct. 23, 2001

(54) REDUCED COST IMPREGNATED WIPES

(76) Inventor: Michael A. Wilkman, 381 Hartz Ave., Suite A, Danville, CA (US) 94526

( * ) Notice: Subject to any disclaimer, the term of this patent is extended or adjusted under 35 U.S.C. 154(b) by 0 days.

(21) Appl. No.: 09/318,350

(22) Filed: May 25, 1999

(51) Int. Cl.[7] ..... B65D 81/24
(52) U.S. Cl. ..... 206/210; 206/440; 206/459.5
(58) Field of Search ..... 206/205, 206, 206/207, 210, 223, 38, 438, 440, 441, 37, 812, 209, 229, 831, 494, 459.5; 40/312, 360, 638; 229/70, 92.8

(56) References Cited

U.S. PATENT DOCUMENTS 3,685,645 * 8/1972 Kawaguchi ..... 206/210
4,696,393 * 9/1987 Laipply ..... 206/210
4,702,378 * 10/1987 Finkel et al. ..... 206/831
4,896,768 * 1/1990 Anderson ..... 206/210
5,009,518 * 4/1991 Faltynek ..... 206/831
5,368,581 * 11/1994 Smith et al. ..... 206/210
5,413,384 * 5/1995 Principe et al. ..... 206/831
5,487,932 * 1/1996 Dunshee ..... 206/210
6,013,614 * 1/2000 Mahdessian ..... 206/812

OTHER PUBLICATIONS

Campbell's, Kellogg's team in soup, cereal promotion, Detroit News, Oct. 12, 1988.*
The Box with the Silver Lining, Brian Oliver, Jan. 13, 1982.*

* cited by examiner

*Primary Examiner*—Luan K. Bui
(74) *Attorney, Agent, or Firm*—Knobbe, Martens, Olson & Bear, LLP

(57) ABSTRACT

The present invention provides a method of reducing the cost of impregnated wipes, by including coupons for other companies' products or services within the packaging of said wipes. Also, a method is provided to track the sales, distribution and redemption of said wipes and coupons, and to electronically provide such information to retailers and advertisers over the internet. The present invention also provides an improved wipe package.

4 Claims, 6 Drawing Sheets

REDUCED COST IMPREGNATED WIPES

BACKGROUND OF THE INVENTION

1. Field of the Invention

The present invention relates to reduced cost impregnated wipes in general, and to a method of directly distributing and tracking coupons and other advertising to a target market.

2. Description of the Related Art

Various types of impregnated wipes are known in the prior art. Such wipes are used for the application of a variety of formularies, such as lotions, sunscreen, insect repellent and cleaning fluids. These wipes are typically marketed as an alternative means to distribute a formulary of the particular company marketing the wipe. For instance, an insect repellent company having a proprietary insect repellent may market an insect repellent wipe, a suntan lotion company may market a suntan lotion wipe, and a cleaning fluid company may market a cleaning fluid wipe.

SUMMARY OF THE INVENTION

The present inventor has developed a new and innovative approach to using, marketing and reducing the cost of impregnated wipes, and a method of improving targeted advertising and even tracking such advertising and the results through such impregnated wipes.

As mentioned above, there are many different impregnated wipes known in the prior art. Many of these wipes have had limited success. The inventor has recognized that the limited success is typically due to the simple placement of a known formulary into an impregnated wipe by the company who owns the formulary.

However, it is often desirable to have a collection of different skin treatment or other fluids at one time. For example, during a camping trip a camper may desire to have on hand sunscreen, insect repellent, anti-itch lotion, sunburn treatment, deodorant and moisturizer. The camper usually brings separate bottles of each, which adds significant unneeded weight and size to the camping gear. Existing impregnated wipes are not grouped as a collection. Rather, a company with a particular formulary simply markets a wipe which carries the same formulary. The present inventor recognized that there is a need to provide a collection of different types of wipes that are suited for a particular purpose or outing. However, such a collection has not been provided.

In addition, the present inventor has also developed a way to more cost-effectively package such impregnated wipes. Most wipes are sold in foil or plastic packages having two sides. Typically, a package for a wipe has printed on it the product name and logo, company name and logo, package ingredients and directions for use. Packaging involves printing such text and designs onto foil or plastic sheets, cutting the sheets to the proper package size, and sealing them together in package form with the impregnated wipe therebetween. Unfortunately, the cost of such packaging is significant in comparison to the cost of making the wipes themselves and also causes a wipe to cost significantly more than the cost would be of purchasing the particular formulary in bottled or other bulk form. In the past, the marketers have believed that those who purchase the wipe will pay a premium for the convenience of having a disposable wipe. However, the significant premium over bulk packaged formularies also limits the market.

The present invention reduces the cost of such wipes significantly, particularly when sold in the collection format.

More revenue to the manufacturer or a decrease in the cost to customers can be realized by charging other companies to advertise their products concurrently with sale of the wipes. Given value-minded consumers, if the packaging cost could be reduced, the cost or the premium over bulk purchase of a particular formulary could be reduced or eliminated, and yet the convenience of the disposable wipe could still be provided. The revenue generated by charging a fee for the provision of distribution and advertising information to retailers and advertisers provides this cost savings.

A limitation of current business methods employed to market wipes is that they do not take advantage of these business opportunities. Indeed, under the present invention, a collection of wipes can be provided or a collection of a particular type of wipe can be provided with advertising or coupons as the packaging material. More importantly, such advertising need not be limited to advertising for the particular owner of the formulary.

For instance, the wipe would have a particular brand known to be associated with the line of impregnated wipes in general, such as SPORTWIPE™, which brand could be associated with advertising and coupons which form a part of the packaging of the impregnated wipes. The advertising and coupons would be directed to the types of consumers that would select that particular wipe or collection of wipes. This is an unusual business method in that, typically, a product formulary owner does not advertise for other companies' products. In the present invention, the formulary need not be owned by the particular company marketing the wipes. Further, the coupons and advertising included as part of the packaging of the wipes may be directed to products sold by or services offered by any company which desires to advertise to the particular target market for the wipe or collection of wipes involved, including companies other than those owning the formulary or those marketing the wipes.

In essence, a collection of wipes could become a type of coupon book directed to the target market for the particular collection of wipes. Thus, the present invention provides a business method to advertise other companies' products concurrently with the sale of the wipes, to provide distribution and advertising information to retailers and advertisers, and also to reduce the cost of the product.

Finally, through the present invention, a coupon which forms a part of the packaging for a particular type of impregnated wipe would have significantly greater target market exposure and shelf life than a typical coupon used in the market today. For example, an insect repellent wipe may be carried in a sportsperson's jacket for months. Each time the sportsperson views the package, he or she will view the coupon for a particular product, which will provide advertising to that user in a repeated fashion. Moreover, when the wipe is finally used, the coupon can be retained for use. Accordingly, the coupon has a drastically increased shelf life as compared to conventional coupon systems.

The present invention also provides for improvements to wipe configurations and to tracking sales on behalf of the retailers.

DETAILED DESCRIPTION OF THE PREFERRED EMBODIMENTS

Figure 1:
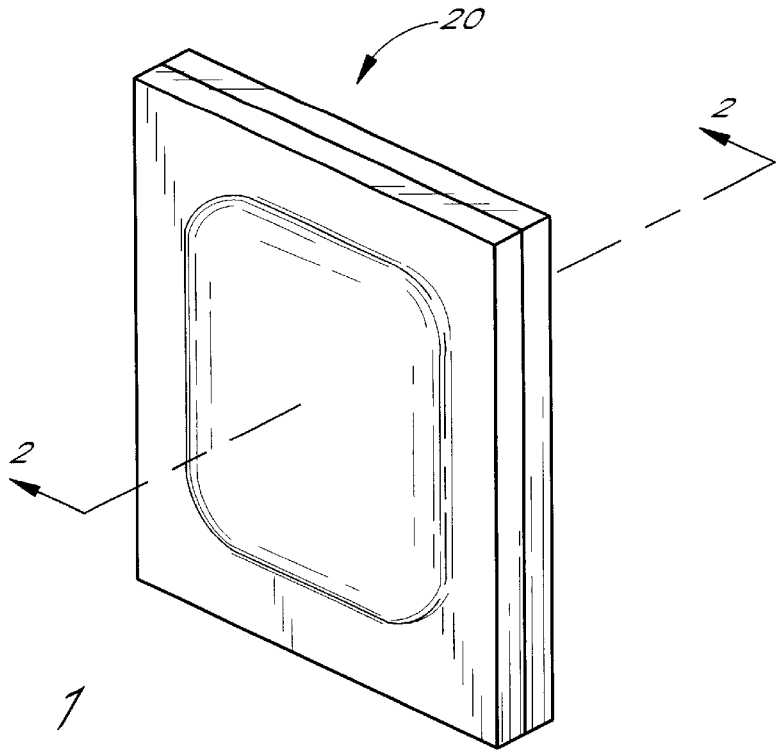
FIG. 1 is a front perspective view of an impregnated wipe package having features and advantages in accordance with a first aspect of the present invention.
Figure 2:
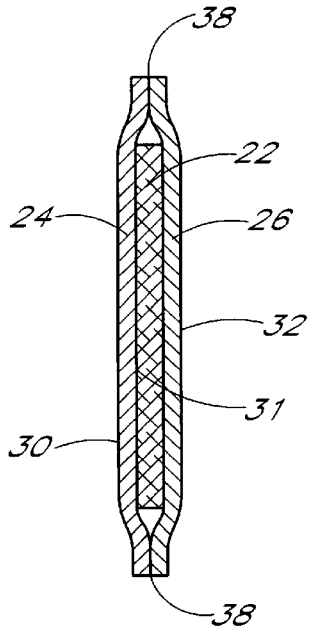
FIG. 2 is a sectional view of the package of FIG. 1, taken along the line 2—2.
Figure 3:
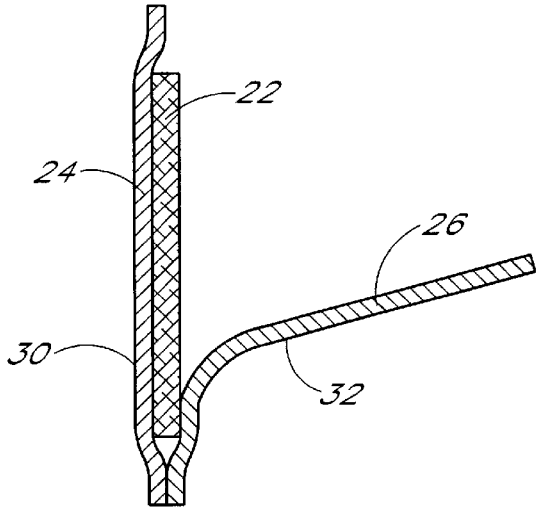
FIG. 3 is a sectional view of the package of FIG. 1, illustrating the peeling off of the rear side coupon of the package.

FIGS. 1–3 illustrate a package 20 containing an impregnated wipe 22 in accordance with a first aspect of the present invention. The package 20 is preferably formed from thin compliant material, such as sealed paper, plastic or foil, as is well known in the art. It is important that the packaging material is sufficiently non-porous, to minimize or prevent absorption of substance on the wipe 22. In the present embodiment, the package 20 includes a front sheet 24 and a rear sheet 26. The edges 38 of sheets 24 and 26 are sealed together so that the rear sheet 26 can be peeled off of the package 20 if desired. Those in the art will understand that any of several well known sealing methods can be employed to achieve the purposes of this invention.

The front sheet 24 of package 20 may have printed on its exterior side 30 any materials relevant to the product, such as the product name, company name, logos, package ingredients, directions for use, promotional materials, etc.. The rear sheet 26 is preferably a coupon or other advertising for another company's product(s) or service(s). In one embodiment, the coupon is adapted to be peeled from the front sheet, as shown in FIG. 3. The advertisement is preferably printed onto the exterior surface 32 of rear sheet 26, so that a purchaser may, in some packaging configurations, see the coupon advertisement before purchasing the package 20.

Figure 4:
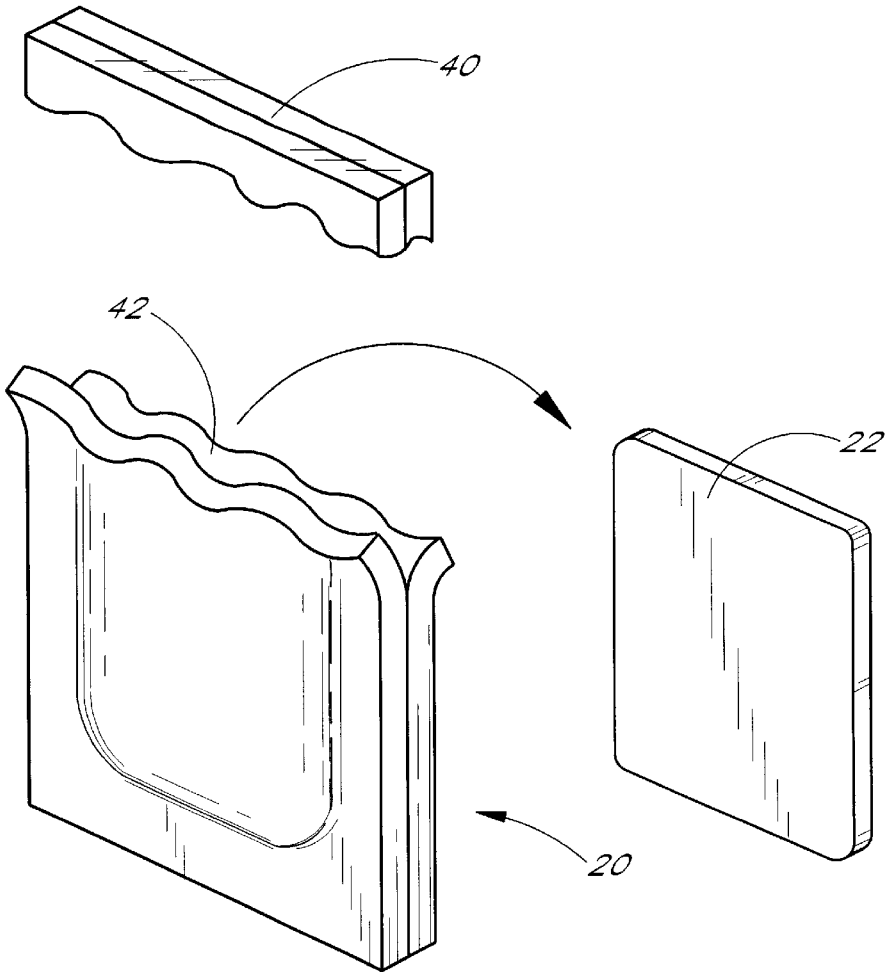
FIG. 4 is a front perspective view of an impregnated wipe package having features and advantages in accordance with a second aspect of the present invention.

An alternative configuration of a wipe package 20 is illustrated in FIG. 4. In this configuration, an end 40 of the package 20 can simply be ripped off, as is typical with impregnated wipes, and the impregnated wipe 22 removed from the tom end 42 of the package, leaving the package edges still sealed together except where the wipe 22 has been removed. In this manner, the package 20 remains the coupon which can be saved for use.

As mentioned previously, impregnated wipes have typically been sold as a single formulary item such as a hand cleaner, a baby wipe, a suntan lotion, or an insect repellent. These wipes are typically sold by the company which also sells more bulk-related products of such formularies. The wipes are used by these companies to provide another marketing channel for the particular formulary. In one advantageous embodiment of the present invention, the impregnated wipes are packaged as kits or collections of various related types of wipes. The collection could be according to any number of criteria. For instance, a cosmetic package may consist of skin care items such as moisturizers, sunblocks, vitamin-enhanced formulas, eye makeup remover, and hand-cleaning or sanitation wipes. Another kit may comprise a camping kit which may contain suntan lotion or block, insect repellent, analgesic lotions or ointments, other first aid formularies, deodorant, foaming shave gel activated upon exposure to oxygen and antiperspirant wipes. Other kits are envisioned for particular applications. A kit would be formulated for particular sports such as fishing, boating, biking, skiing, and any other sport in which a formulary product or collection of such products is useful. Kits may also be formulated for beach outings, picnics, swimming, etc. By grouping the wipes in such configurations, the need to carry containers of the various lotions and other products during an outing is eliminated. For instance, during a camping trip a camper may desire to have on hand sunscreen, insect repellent, anti-itch lotion, sunburn treatment, deodorant and moisturizer. The camper could bring bottles of each of these fluids, but that would add significant unneeded weight and size to the camping gear. In addition, with common changes of altitudes for such camping activities, the bottles often leak due to pressure changes in the altitude. In comparison, it is less burdensome to carry a collection of impregnated wipes, and the risk of leakage is very small. Accordingly, the present invention includes the provision of kits or collections of related wipes.

As mentioned above, the wipe package 20 of the present invention includes a coupon 26 which forms a significant portion of the package 20. In the present embodiment, the back of the package comprises a coupon. There are numerous business advantages associated with including coupons as a part of the packaging of wipes. According to the business method of the present invention, the product marketer or manufacturer advantageously generates additional revenue and/or subsidizes some or all of the cost of packaging the wipes by including coupons or other advertisements for other companies' products as part of the packaging. The other companies would be charged a fee for placing an advertisement on a package 20 of a wipe 22. This advertising revenue offsets the cost of manufacturing and distributing the wipes 22. Preferably, these companies or coupon-advertisers provide camera-ready artwork for the rear sheet 26 according to the manufacturer's specifications. The manufacturer can also design and make the coupons 26 for a fee.

The provision of coupons or advertisements from companies which do not provide the wipes is not found in the impregnated wipes market. To the contrary, companies typically advertise or provide coupons for their own products only. By permitting other companies to advertise their related bulk products or to even sponsor the formulary in a particular line of the impregnated wipes brand, the advertiser or coupon provider will pay a fee which subsidizes the purchase price to the end-user. This would permit a substantial reduction in the purchase price which would bring the premium for impregnated wipes to a much lower level or equivalent to purchasing the bulk products. Alternatively, the additional revenue could be used to provide for increased margins for the maker.

Another advantage of including coupons or advertisements on wipe packages is that the coupon or ad has a longer "shelf life," and thereby provides more advertising longevity. A wipe may be kept in the possession of the purchaser for a long time before being used. During that time, the purchaser may notice or be reminded of the coupon several times. As a result, the coupon or ad has a longer "shelf life" than a typical coupon or ad that is disposed of virtually immediately.

For example, a wipe may have a coupon offering a discount on the purchase of tennis balls. At the time the purchaser buys the wipe he or she may not have any need for tennis balls. However, the wipe may not be used for weeks or months, during which time the need for tennis balls may arise. Because the coupon is included within the package of an unused wipe, the purchaser will not dispose of the coupon or ad until the wipe is used. In other words, the coupon or ad forms the package and, therefore, the coupon or ad is functional and is not disposed of in the short term unlike traditional advertisements in newspapers and the like. Thus, there is a greater opportunity for the coupon to eventually be used, resulting in a sale by the advertiser.

Another advantage of including coupons on wipe packages is that coupons may be distributed directly to a general target market. For example, coupons for beach accessories could be included within packages for beach-related wipes, such as suntan lotion wipes. Furthermore, coupons may be distributed directly to a more specific target market, perhaps identified by the purchase orders received by the wipe manufacturer. According to the business method of this invention, the manufacturer gives coupon advertisers the option of combining their coupons with any specific purchase order(s) of wipes. For example, a wipe manufacturer may receive an order for 1000 wipes from Retailer X in City Y. Coupon Advertiser Z may wish to distribute coupons or ads directly to the customers of Retailer X. This provides for vast improvement in coupon placement and distribution over conventional advertising. Conventional advertisers guarantee a particular circulation, but it is difficult to isolate the types of customers who will receive the advertising. The more directly the advertisement can be traced to the consumer the advertisement is intended for, the more valuable the advertising. In one embodiment in accordance with the present invention, because the wipe manufacturer may solicit advertising for a particular known purchase order from a particular retailer or other customer, a prospective advertiser can be assured that the advertising coupons are being placed in the particular target market which is desired. Coupon Advertiser Z simply buys space for its coupons to be placed on packages of those wipes sent to the desired retailer and wipe.

Another important advantage of including coupons is that, by tracking the sales and shipments of wipes and coupons, a wipe manufacturer can provide valuable distribution and advertising information to retailers and coupon-advertisers. According to the business method of the present invention, the manufacturer maintains a world wide website wherein retailers and coupon-advertisers can access confidential records pertaining to the distribution of wipes and coupons. Individual passwords are provided to the retailers and coupon-advertisers to maintain confidentiality of their records.

According to this business method, retailers and coupon-advertisers may access valuable distribution information to aid them in making future orders and requests. In particular, a retailer can learn the quantities of each type of wipe and coupon that have been ordered in the past. Such information allows the retailer to more easily identify those wipes and coupons that are generating significant sales, as well as those that are not. The retailer can then change future orders to reflect which wipes/coupons are selling successfully. Similarly, the coupon-advertisers may receive direct data on how many of their coupons have been distributed to a given geographic location. They can also learn which coupon-wipe combinations sell most frequently. Also, by comparing the quantity of coupons shipped to the quantity eventually redeemed, a coupon-advertiser can determine the redemption rate for any given coupon in a particular geographic location or channel of trade. The coupon-advertiser may then direct the manufacturer as to how many and what types of coupons are to be sent to each geographic location or channel of trade, as well as which wipes the coupons are to be combined with.

In accordance with the present invention, this information can be provided on a worldwide website accessible by the various users and the advertisers with a given password, as will be understood by those of skill in the art. This reduces the overhead for the retailers and the advertisers, who would typically track such information on their own, often in a less reliable fashion.

Figure 5:
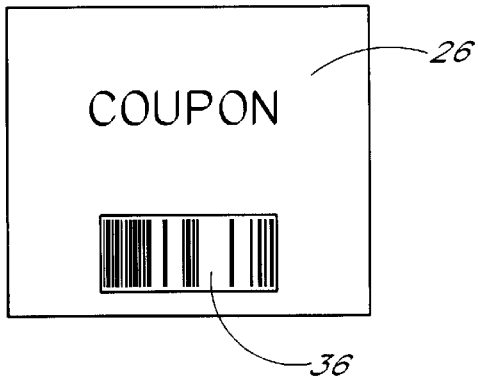
FIG. 5 is a rear view of a coupon having features and advantages according to a third aspect of the present invention.

FIG. 5 illustrates a coupon 26 of the present invention. According to the business method of this invention, each coupon 26 includes a bar code 36 for identification purposes. Each bar code 36 is scannable by well known methods, and when scanned is configured to reveal a coupon identification code. Advantageously, the bar code may also be configured to identify the particular wipe from which the coupon originated, by revealing a wipe identification code. These identification codes correspond to the particular coupon and the particular type of wipe included within the package, respectively. Further, the bar code of a coupon may be scanned at three separate stages. It may be scanned when the wipe manufacturer distributes the wipes to a retailer (distribution stage), when the retailer sells the wipe package (retail stage), or when the purchaser redeems the coupon (redemption stage).

Figure 6:
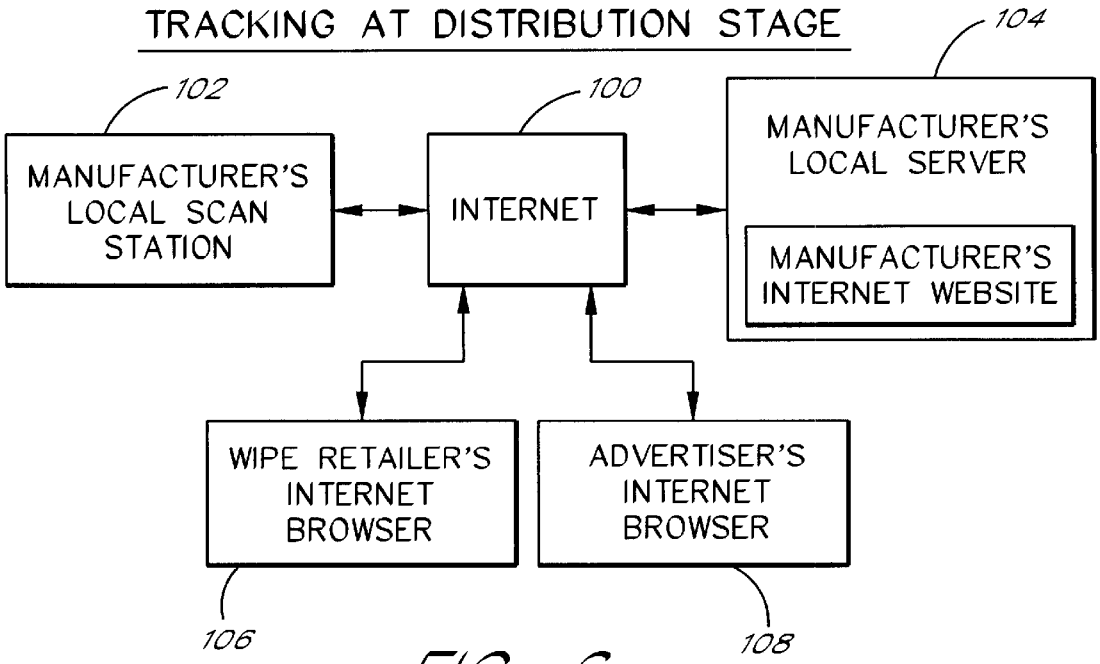
FIG. 6 is a block diagram illustrating a method of tracking the distribution of wipes and coupons.

According to one preferred business method of this invention, illustrated in FIG. 6, the regular practice of the wipe manufacturer is to scan the bar code 36 at the distribution stage, in order to keep track of the quantity of every type of wipe, coupon, and wipe-coupon combination sold and shipped to each retailer. As illustrated in FIG. 6, a system to implement this method utilizes the Internet 100. A manufacturer's local scan station 102 provides data via the Internet to the manufacturer's local server which maintains an Internet site to access relevant data. Alternatively, the manufacturer's local scan station 102 is coupled directly to the manufacturer's local server 104. However, use of the Internet 100 allows the manufacturer to have multiple local scan stations at different manufacturing points, and one server maintaining the Internet site. The retailers may access information about their own shipments from the manufacturer through their own browser 106. Similarly, advertisers may access the usage of their coupons, such as the numbers and locations of shipments via their browser 108. The retailers and advertisers, advantageously, access the manufacturer's Internet site through password protected access codes. Preferably, the manufacturer's Internet site is restricted to registered users, and furthermore, restricts each user to access to its own information. Each time the manufacturer receives an order for wipes of various types and quantities, the manufacturer scans the bar code 36 of each wipe package before packing and shipping it to the retailer. The manufacturer records the coupon identification code and wipe identification code of each coupon distributed, as well as the location of the retailer where the wipes will be sold. As indicated above, access to some or all of this information is provided to the ordering retailer and coupon advertiser via the Internet site controlled and maintained by the manufacturer.

Figure 7:
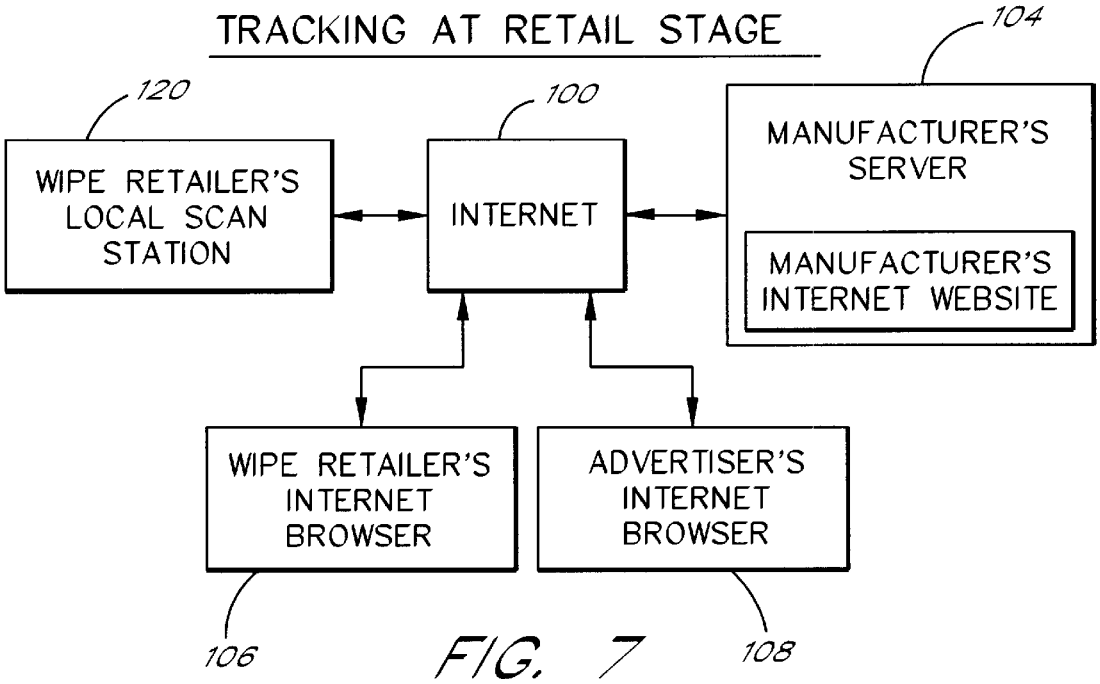
FIG. 7 is a block diagram illustrating an alternative method of tracking the distribution of wipes and coupons.

The same benefits may be obtained if instead, the regular practice is for the retailer to scan the bar code 36 at the retail stage, i.e., every time a wipe/coupon is sold. According to this model, illustrated in FIG. 7, the retailer is supplied with a middleware software program that tracks coupon identification codes, wipe identification codes, and location of sale. As illustrated in FIG. 7, again the manufacturer maintains a Internet site 104 accessible via the Internet 100. Information stored on the manufacturer's Internet website with a database is provided by the retailer's local scan station 120. For example, each time a retailer sells a package of wipes, the middleware software solution may automatically connect to the Internet and provide such information to the manufacturer's server 104. Alternatively, the retailer periodically uploads such information to the manufacturer's server 104. Similar to the embodiment of tracking at the distribution station of FIG. 6, the retailers may access their own usage and the advertisers may access the usage of their coupons by accessing the manufacturer's server 104 via the Internet 100. The middleware may be adapted to transmit information to the manufacturer's server on a scheduled basis. The manufacturer's server is equipped with software that updates the manufacturer's website to reflect the sale of each particular wipe/coupon. While scanning at the retail stage provides the same information as scanning during the distribution stage described above, the latter is preferred because it provides the manufacturer with greater control over the entire record-keeping process, resulting in a better and more accurate website for the retailer and advertiser.

Figure 8:
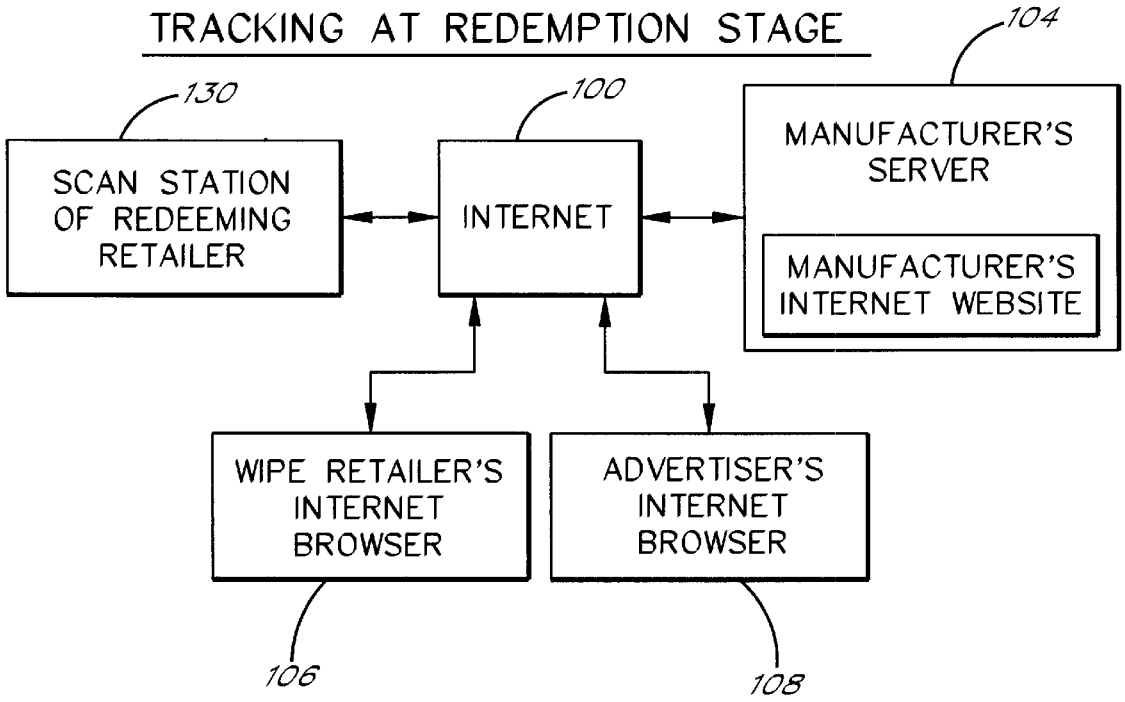
FIG. 8 is a block diagram illustrating a method of tracking the redemption of coupons.

Finally, scanning the bar code 36 at the redemption stage provides attractive benefits to coupon-advertisers. According to this model, illustrated in FIG. 8, retailers of all of the products and/or services advertised in the coupons are provided with middleware software that scans the bar code of a coupon and transmits the coupon identification code, wipe identification code, and location of redemption back to the manufacturer's server. The manufacturer's server 104 is equipped with software that updates the manufacturer's website to reflect the redemption of that particular coupon. The website provides this data to the coupon-advertisers. Preferably, the website also displays the redemption rates for each of the advertiser's coupon-types in each of the geographic locations and channels of trade to which the coupons were distributed. Thus, the advertiser can learn which coupons are being redeemed more frequently, and the location of most frequent redemption for any given coupon type. This, of course, allows both the wipe company and advertiser to more accurately value the advertising. In this embodiment, the system would comprise the Internet 100, the manufacturer's server 104 and the retailer Internet browser 106 and the advertiser Internet browser 108. In place of the wipe retailer's local scan station or manufacturer's local scan station a scan station 130 of the redeeming party is provided with a middleware solution which uploads data preferably on a automatically schedule periodic basis, to the manufacturer's server about coupon redemption.

Figure 9:
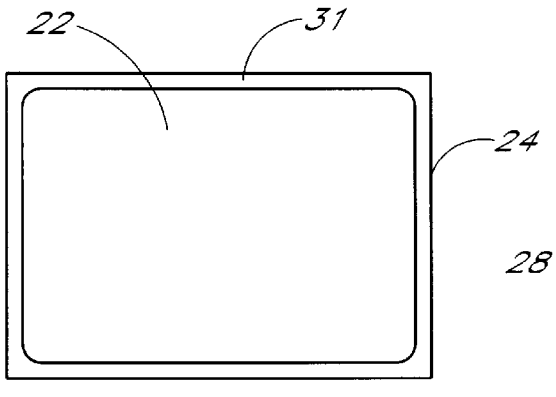
FIG. 9 is a rear view of the package of FIG. 1 with the rear side coupon peeled off, illustrating an impregnated wipe having features and advantages according to a fourth aspect of the present invention.

FIG. 9 depicts an alternative embodiment of an advantageous package 20 for use with formularies which may be particularly bothersome when left on the hands. As depicted in FIG. 9, the package 20 is ready for use after the rear sheet coupon 26 (FIG. 2) has been peeled off. Wipe 22 is preferably secured to the interior surface 31 of front sheet 24 of the package 20. Preferably, wipe 22 is glued onto surface 31. Also, wipe 22 can be formed from any well-known material, as will be apparent to those in the art. Preferably, such material is significantly porous to promote the absorption of lotion or other fluids. A user can apply the impregnated formulary to his or her skin simply by positioning the wipe 22 onto the skin and wiping with one hand placed on the dry exterior surface 30 (FIG. 2) of front sheet 24. This embodiment is particularly useful for compounds which may be bothersome, such as a zinc oxide sunblock formulary to be placed on the user's nose or other sensitive sun exposed portions of the body without leaving the zinc oxide residue on the fingers of the user.

Figure 10:
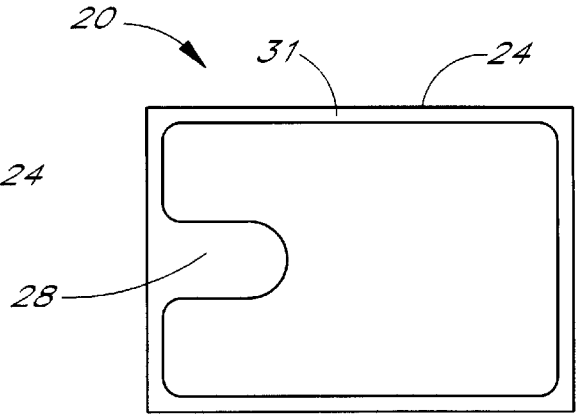
FIG. 10 is a rear view of an impregnated wipe having features and advantages according to a fifth aspect of the present invention.
Figure 11:
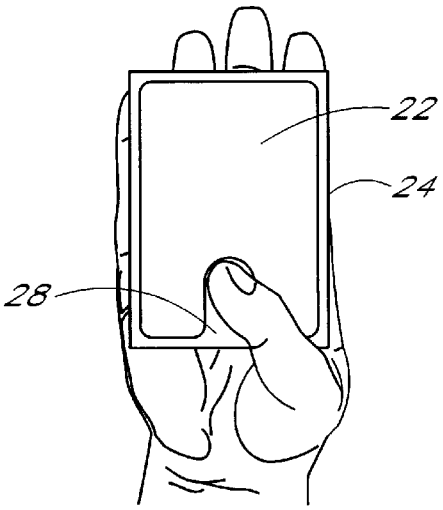
FIG. 11 illustrates a preferred method of use of an impregnated wipe of the present invention.

Another embodiment of the present invention is depicted in FIG. 10. As explained above, the advantage of having a wipe attached to the package 20 is that it allows the user to avoid leaving residue on his or her fingers after use. Accordingly, as depicted in FIG. 10, in order to allow for increased control during application, wipe 22 optionally includes a dry notch 28. This allows the user to place a finger on the interior surface 31 of front sheet 24, within the notch 28, without getting lotion or other fluids on the user's hand. Best results are achieved by placing one's thumb in the notch 28 and the other four fingers on the exterior surface 30 of sheet 24, as shown in FIG. 11. A plurality of notches 28 could also be provided.

The notch 28 may be any of a wide range of shapes. For example, referring to FIG. 13A, the wipe 22 is secured to the interior surface 31 of front sheet 24, as discussed above. However, the wipe 22 is smaller than the interior surface 31 of the front sheet 24 so that a user may place a thumb or other digit on a periphery 40 of the front sheet 24 without contacting the formulary in the wipe 22. This may be advantageous in application of the formulary.

Figure 13A:
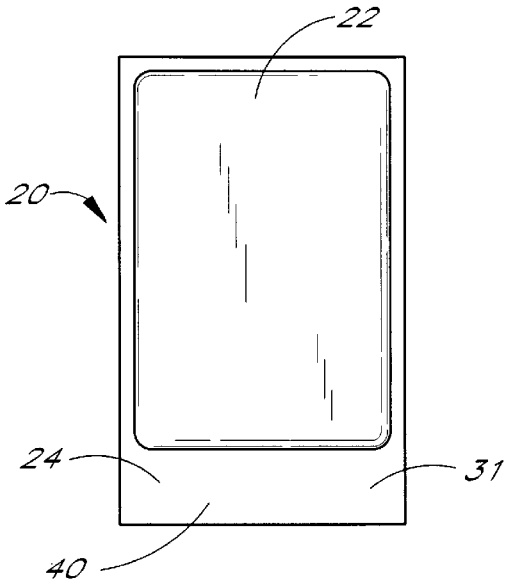
FIG. 13A is a rear view of an alternative embodiment of the impregnated wipe of FIG. 10.
Figure 13B:
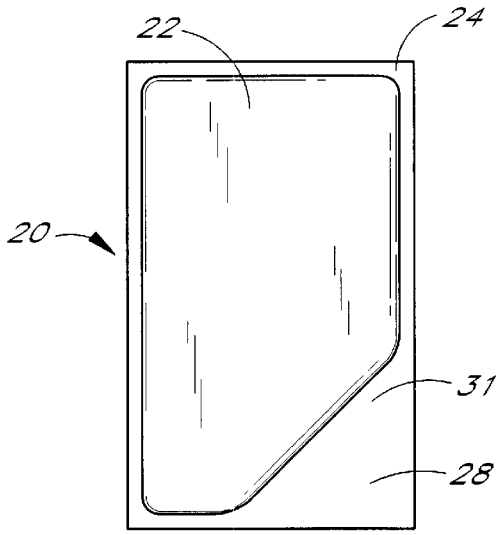
FIG. 13B is a rear view of another alternative embodiment of the impregnated wipe of FIG. 10.
Figure 13C:
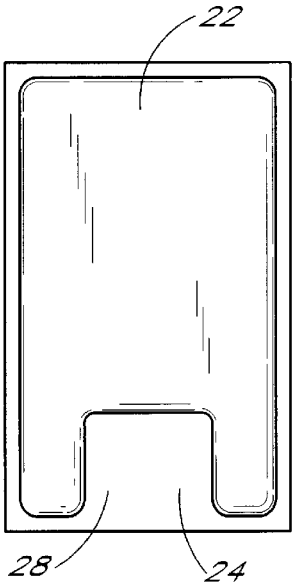
FIG. 13C is a rear view of yet another alternative embodiment of the impregnated wipe of FIG. 10.

FIG. 13B illustrates an alternative embodiment of the wipe 22 secured to the inner surface 31 of the front sheet 24. The wipe 22 in this embodiment is angled such that the notch 28 permits easy application of the formulary, as will be understood by those skilled in the art. As illustrated in FIG. 13C, the wipe 22 may be configured in any of a wide range of shapes to accommodate a notch 28 in the wipe 22 to permit application of the formulary in the wipe 22 without a user's thumb or other digit contacting the formulary in the wipe 22.

Figure 14:
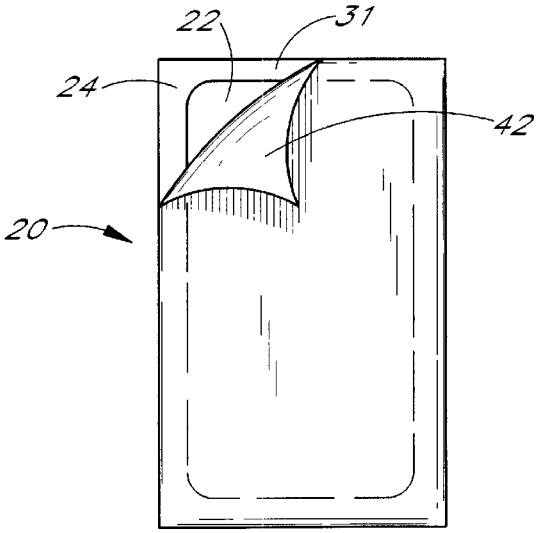
FIG. 14 is a rear view of an impregnated wipe having features and advantages according to a seventh aspect of the present invention.

FIG. 14 illustrates a wipe 22 secured to the inner surface 31 of a front sheet 24 of the package 20. In this embodiment, an extra layer 42 of cellophane or other materials known to those of skill in the art is provided between the wipe 22 and the second or back sheet 26 (not shown). Once the back sheet is removed, the layer 42 may be peeled back to permit application of the formulary without contact therewith. For example, an individual may hold the outer surface of the front sheet 24 and the surface of the layer 42 away from the wipe 22 so as to prevent contact with the wipe 22. However, because the layer 42 is peeled back exposing a portion of the wipe 22, application of the formulary may be accomplished, as will be understood by those of skill in the art.

Figure 12:
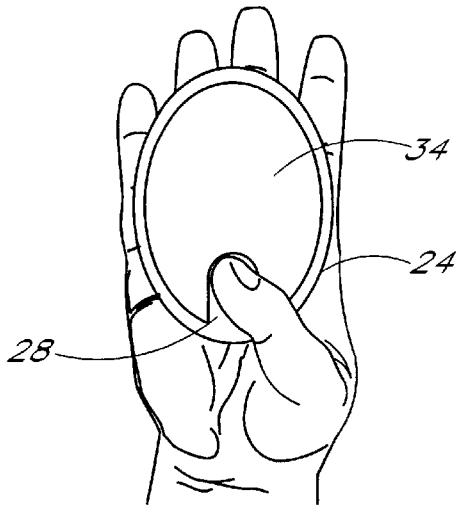
FIG. 12 illustrates an impregnated wipe having features and advantages in accordance with a sixth aspect of the present invention, sized and shaped for improved application of formulary to a person's skin.

FIG. 12 illustrates another alternative embodiment of the present invention. Conventional wipes are typically rectangular or square which can be awkward to use. Accordingly, FIG. 12 illustrates an improved shape for an impregnated wipe. A wipe 34 is shaped and configured for improved manageability and easier application of the impregnated formulary. In particular, wipe 34 is adapted to prevent excessive folding or rolling during use. Wipe 34 has a substantially curvilinear shape, without any sharp comers that would normally promote folding or rolling of the wipe 34. In an embodiment where the curved shape wipe is attached to one side of the package as in the embodiment of FIG. 9, the wipe could have an oval shape as in FIG. 12, which is approximately sized to fit within a person's hand. In this embodiment, the wipe 34, front sheet 24, and rear sheet 26 may have substantially the same shape. Although shown in an oval shape, wipe 34 could be configured to have any of a variety of suitable shapes (such as circular) and sizes, giving due consideration to the goals of improved manageability, ease of use, and substantial prevention of rolling or folding of the edges of the wipe. Also, wipe 34 preferably includes a dry notch 28 as described above in the embodiment of FIGS. 10 and 11.

Moreover, the periphery of a package 20 need not correspond with the outer dimension of a wipe 22. For example, the package 20 may be square or rectangular and the wipe 22 could be oval or round, as will be readily understood by those of skill in the art. For example, FIGS. 13A and 13B illustrate a wipe 22 having an outer periphery which does not correspond with the outer periphery of the package 20.

Figure 15:
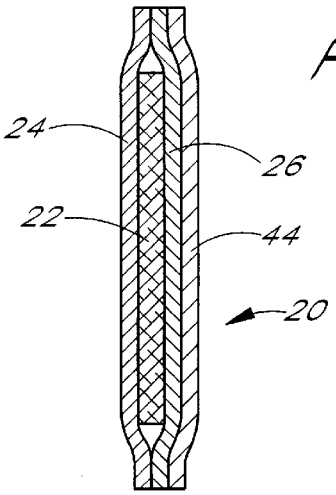
FIG. 15 is a cross-sectional view of an impregnated wipe having features and advantages according to an eighth aspect of the present invention.

Referring to FIG. 15, another embodiment of the package 20 is shown. In this embodiment, the wipe 22 is secured between a front sheet 24 and a rear sheet 26, as described with respect to FIGS. 1–3 above; however, an additional second rear sheet 44 is secured to the rear sheet 26 by any method known to those of skill in the art. In this embodiment, a coupon may be printed on the second rear sheet 44. If an individual wishes to redeem the coupon, the individual may peel off the second rear sheet 44 and redeem the coupon without opening and exposing the wipe 22. That is, the wipe 22 would remain securely packaged between the front and rear sheets 24, 26. In this embodiment of the package 20, a second coupon may be printed on the rear sheet 26. Thus, the package 20 may contain a plurality of coupons on a plurality of sheets, as will be understood by those of skill in the art. Advantageously, this method permits consumers to redeem coupons immediately and use a wipe 22 at a later time.

Although this invention has been disclosed in the context of certain preferred embodiments and examples, it will be understood by those skilled in the art that the present invention extends beyond the specifically disclosed embodiments to other alternative embodiments and/or uses of the invention. Thus, it is intended that the scope of the present invention herein disclosed should not be limited by the particular disclosed embodiments described above, but should be determined only by a fair reading of the claims that follow.

What is claimed is:

1. A wipe package comprising a front sheet, a wipe secured to said front sheet, and a rear sheet, wherein said front sheet and said rear sheet are sealed together to enclose said wipe, and wherein said rear sheet is adapted to be peeled off of said front sheet, wherein said wipe has a notch sized and configured to permit an end of a human finger to be placed within said notch so that said finger is in direct contact with said front sheet, and so that said finger is not in contact with said wipe.

2. A package according to claim 1, wherein said wipe has a substantially curvilinear shape.

3. A package according to claim 1, wherein said package contains a second rear sheet including a coupon.

4. A package according to claim 1, wherein said front sheet is sized and configured to fit within a human hand.

* * * * *